US006653768B2

(12) United States Patent
Kato et al.

(10) Patent No.: US 6,653,768 B2
(45) Date of Patent: Nov. 25, 2003

(54) SPARK PLUG

(75) Inventors: Tomoaki Kato, Aichi (JP); Mamoru Musasa, Aichi (JP)

(73) Assignee: NGK Spark Plug Co., Ltd., Aichi (JP)

( * ) Notice: Subject to any disclaimer, the term of this patent is extended or adjusted under 35 U.S.C. 154(b) by 103 days.

(21) Appl. No.: 10/023,939

(22) Filed: Dec. 21, 2001

(65) Prior Publication Data

US 2002/0140333 A1 Oct. 3, 2002

(30) Foreign Application Priority Data

Dec. 27, 2000 (JP) ..... 2000-397381

(51) Int. Cl.[7] ..... H01T 13/14
(52) U.S. Cl. ..... 313/143; 313/141; 313/145
(58) Field of Search ..... 313/141–145; 123/69 EL

(56) References Cited

U.S. PATENT DOCUMENTS 5,831,377 A * 11/1998 Matsubara et al. ..... 313/141
6,265,816 B1 * 7/2001 Ito et al. ..... 313/141
6,559,579 B2 * 5/2003 Ito et al. ..... 313/143

FOREIGN PATENT DOCUMENTS

JP 60-14781 1/1985
JP 60-62082 4/1985
JP 6-196247 7/1994
JP 7-130452 5/1995
JP 11 27 38 27 10/1999

* cited by examiner

*Primary Examiner*—Ashok Patel
(74) *Attorney, Agent, or Firm*—Sughrue Mion, PLLC

(57) ABSTRACT

A spark plug in which the diameter of a front end portion 2*i* of an insulator 2 is reduced due to a circumferentially extending stepped portion thereof to form the stepped portion into an insulator-side locking portion 2*h*, and the insulator is inserted into a main metal member 1 from a rear opened portion thereof. The insulator-side locking portion 2*h* engages a metal member-side locking portion 1*c* projecting from an inner circumferential surface of the main metal member 1, and an outer circumferential surface (clearance-forming outer circumferential surface) 2*k* of the portion 2*i* positioned ahead of the locking portion 2*h* of the insulator 2 is opposed to an inner circumferential surface (clearance-forming inner circumferential surface) 52 of the metal member-side locking portion 1*c* so as to form a predetermined clearance Q in a locking position. An amount β of clearance in the locking position expressed by the equation β=(D1−d1)/2 where d1 represents an outer diameter of the clearance-forming outer circumferential surface 2*k*; and D1 represents an inner diameter of the clearance-forming inner circumferential surface 52, is set to 0.05 to 0.4 mm. The length or distance of the clearance amount β in an axial direction of the spark plug is set to 0.5–2.5 mm.

14 Claims, 6 Drawing Sheets

$$\beta = \frac{D_1 - d_1}{2}$$

$$E = \frac{D_2 - d_2}{2}$$

$$J = \frac{D_3 - d_3}{2}$$

$$\beta = \frac{D_1 - d_1}{2}$$

$$E = \frac{D_2 - d_2}{2}$$

$$J = \frac{D_3 - d_3}{2}$$

$$\beta = \frac{D_1 - d_1}{2}$$

$$E = \frac{D_2 - d_2}{2}$$

$$J = \frac{D_3 - d_3}{2}$$

$$\beta = \frac{D_1 - d_1}{2}$$

$$E = \frac{D_2 - d_2}{2}$$

$$J = \frac{D_3 - d_3}{2}$$

SPARK PLUG

BACKGROUND OF THE INVENTION

1. Field of the Invention

This invention relates to a miniaturized spark plug having improved fouling resistance.

2. Description of the Related Art

In recent years, with the improvement of the performance of engines to higher levels, the construction of an engine head has become complicated. Also, the available space for fixing a spark plug used to ignite an internal combustion engine, such as an automobile gasoline engine and the like, has decreased. Therefore, the development of a miniaturized spark plug has been in great demand. The miniaturization of a spark plug involves a reduction in the diameter of a main metal member (metallic shell) on which a mounting portion with respect to an engine head is formed. However, a diameter of an insulator inserted through an inner side of the main metal member cannot carelessly be reduced in view of the necessity of maintaining the voltage resistance of the spark plug.

The diameter of a front end portion of an insulator of a related art spark plug is reduced due to the provision of a stepped portion formed thereon, and the insulator is combined with a main metal member with the stepped portion engaged with a projection formed on an inner circumferential surface of the main metal member. Therefore, in order to reduce the diameter of the main metal member in such a structure, a method of reducing the clearance width between the inner circumferential surface of the projection of the main metal member and the outer circumferential surface of the insulator opposed thereto is employed. This is because there is a limit to the reduction of the outer diameter of the insulator.

3. Problems to Be Solved by the Invention

However, when the width of the clearance is reduced, the fouling resistance of the spark plug is deteriorated. Namely, when the spark plug is used in a low-temperature environment of an electrode temperature of not higher than 450° C., it generates a large amount of unburnt gas. When such an unburnt gas generating condition continues for a long period of time during, for example, predelivery of a gaseous mixture, the insulator is placed in a so-called "smoking" or "fogging" condition. As a result, the surface of the insulator inside the metal member is contaminated with a conductive substance, such as carbon, etc., and imperfect operation of the insulator is liable to occur. Especially, when the surface of the insulator is contaminated in the above-mentioned clearance due to entry of unburnt gas thereinto, spark discharge occurs in the clearance, and normal ignition cannot be sustained.

SUMMARY OF THE INVENTION

The present invention has been made in view of the above problems of the prior art, and an object of the present invention is to provide a spark plug having a structure that is suitably miniaturized without impairing the fouling resistance thereof.

The above object of the present invention has been achieved by providing a spark plug having a center electrode 3, an insulator 2 provided on the outer side of the center electrode 3, a cylindrical main metal member 1 provided on the outer side of the insulator 2, and an earth electrode 4 which is provided so that the earth electrode is combined at one end portion thereof with the main metal member 1 and opposed at the other end portion thereof to a free end of the center electrode 3, and which forms a spark discharge gap g between the earth electrode and center electrode. The spark plug has a front side at which the spark discharge gap g is positioned with respect to an axial direction O of the insulator 2 with the other side being a rear side, characterized in that the insulator 2, a diameter of a front end portion 2*i* of which is reduced by a circumferentially extending stepped portion thereof provided as an insulator-side locking portion 2*h*, is inserted into the main metal member from a rear opening thereof. The insulator-side locking portion 2*h* is engaged with a metal member-side locking portion 1*c* projecting from an inner circumferential surface of the main metal member with an outer circumferential surface (clearance-forming outer circumferential surface) 2*k* of the portion 2*i* positioned ahead of the locking portion 2*h* of the insulator 2 opposed to an inner circumferential surface (clearance-forming inner circumferential surface) 52 so as to form in a locking position a clearance Q of a predetermined amount therebetween. Furthermore, an amount β of the clearance in the locking position is expressed by the equation:

$$\beta=(D1-d1)/2 \quad (1)$$

wherein d1 represents an outer diameter of the clearance-forming outer circumferential surface 2*k*; and D1 represents an inner diameter of the clearance-forming inner circumferential surface 52, where β is not greater than 0.4 mm but not smaller than 0.05 mm.

When the difference D1−d1 between the outer diameter d1 of the clearance-forming outer circumferential surface and the inner diameter D1 of the clearance-forming inner circumferential surface differs depending upon the axial position, the amount β of a clearance in the locking position is represented by a value obtained at a position in which the diameter difference becomes minimal. Although the metal member-side locking portion can be formed of, for example, an annular projection, it is not limited to this mode as long as it can function as a locking portion.

In order to reduce the outer diameter of the main metal member without impairing the voltage resisting characteristics of the spark plug as described above, the wall thickness of the insulator cannot be greatly reduced. Thus, the amount β of clearance in the locking position is necessarily reduced. However, setting a value of P to the highest possible level so as to prevent the generation of jumping sparks in this clearance when the spark plug is fouled has heretofore been the conventional approach. Therefore, reducing the amount β of the clearance in the locking position to meet a demand for miniaturizing a spark plug has heretofore been considered to be problematic in view of the necessity of preventing the occurrence of jumping sparks when the spark plug is fouled.

The present inventors have carefully studied the amount β of the clearance in the locking position to discover that, when this amount is positively reduced to less than a certain limit (where conventionally at least 0.5 mm was thought to be necessary), the fouling resistance of the spark plug is unexpectedly improved to a remarkable extent, and jumping sparks occurring in the clearance in the locking position when the spark plug is fouled can be prevented. The present invention was thus completed based on these findings. More concretely, when the amount β of the clearance in the locking position is set to not higher than 0.4 mm, entry of unburnt gas into the clearance in the locking position can be reliably blocked, and contamination of the insulator surface in the clearance in the locking position can be prevented. As a result, spark plug miniaturization can be effectively attained without impairing the fouling resistance thereof.

When the amount β of the clearance in the locking position exceeds 0.4 mm, it becomes difficult to prevent entry of an unburnt gas into the clearance. Thus, it becomes impossible to prevent contamination of the insulator surface in the clearance in the locking position. When the amount β of the clearance in the locking position becomes extremely small, contaminants do not enter into the clearance in the locking position. However, when contaminants are deposited on the portion of the insulator surface which extends forward of the clearance in the locking position, a layer of accumulated contaminant contacts the locking portion of the main metal member positioned on the opposite side thereof via the clearance in the locking position, and is liable to cause a short-circuit to occur. Consequently, ignitability of the spark plug may be impaired in some cases. Giving consideration to this point, it is preferable to set the amount β of the clearance in the locking position to not smaller than 0.05 mm, and more preferably not smaller than 0.2 mm.

In another aspect of the invention, this clearance Q needs a clearance distance (βL) extending in the locking position, which means that an annular space defined by the clearance amount (β) measured in a radial direction of the spark plug and the clearance distance (βL) measured in an axial direction of the spark plug is incorporated between an inner circumferential surface 52 of the main metal member 1 and an outer circumferential surface 2*k* of the insulator 2 (in reference to the encircled drawing in FIG. 1). In other words, the clearance amount (β) of 0.05–0.4 mm should continue or be maintained for a distance or length of at least 0.5 mm in the axial direction so as to attain effective protection of the clearance interior from fouling. However, if the clearance distance (QL) exceeds 2.5 mm, deposits such as carbon are liable to accumulate on the insulator around the clearance Q, causing jumping-sparks there. Therefore, the clearance distance should be 0.5–2.5 mm so long as the clearance amount (β) (or rather width) of 0.05–0.4 mm is maintained over that distance. The best fouling resistance for the spark plugs is attained when the above mentioned circumferential surfaces forming the annular space run in parallel in a distance of 1–2.5 mm by maintaining a clearance amount of 0.2–0.4 mm. As a result, a miniaturized spark plug can spark without impairing the fouling resistance thereof.

BRIEF DESCRIPTION OF THE DRAWINGS

FIGS. 4(*b*) and 4(*c*) show further modifications at a position in which flat portion 52*a* and inclined portion 52*b* of the inner circumferential surface 52 of the insulator meet.

DESCRIPTION OF THE PREFERRED EMBODIMENTS

Preferred embodiments of the present invention will now be described with reference to the drawings. However, the present invention should not be construed as being limited thereto.

Figure 1:
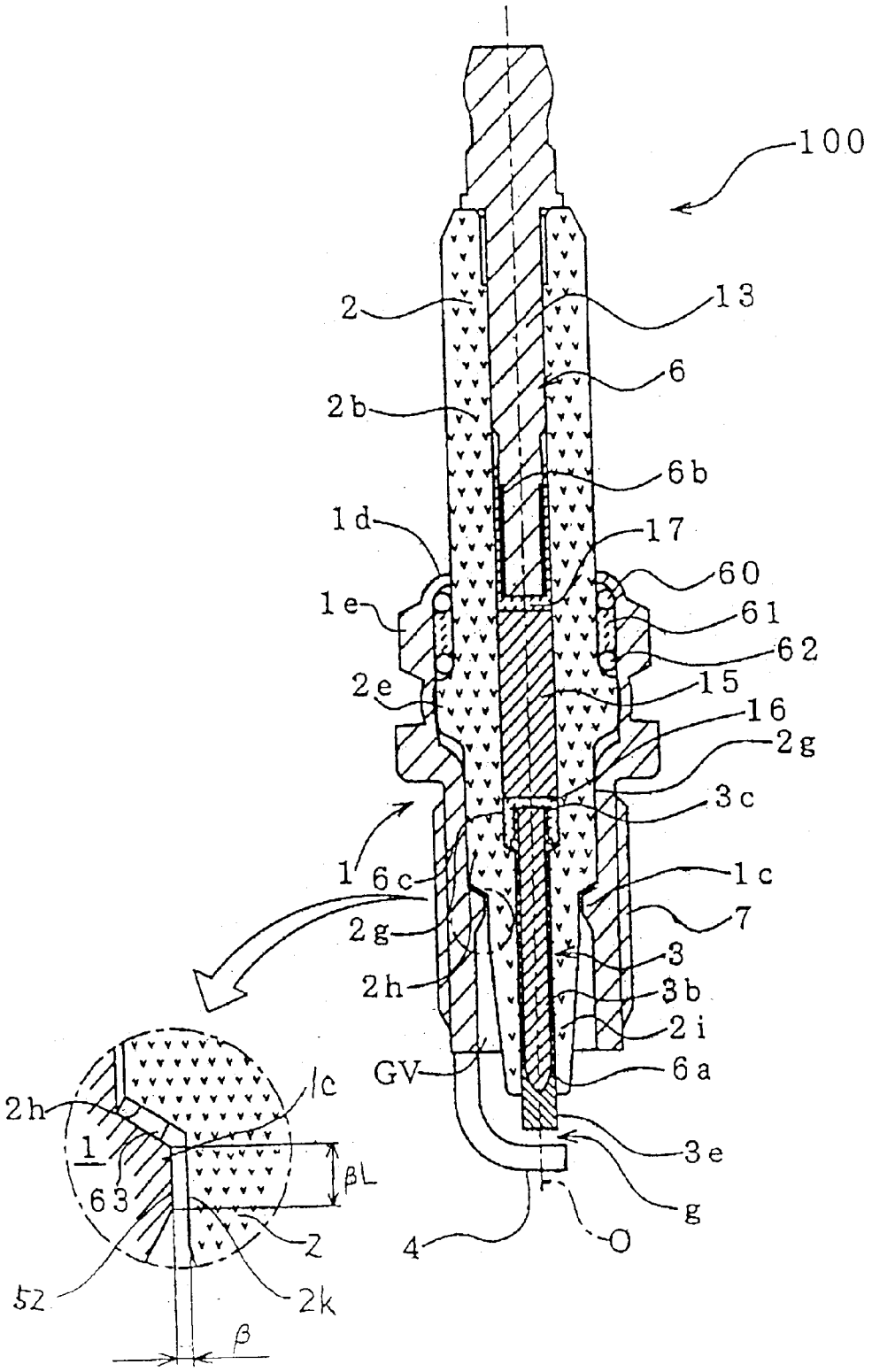
FIG. 1 is a longitudinal sectional view showing a general construction of an embodiment of the spark plug according to the present invention.
Figure 2:
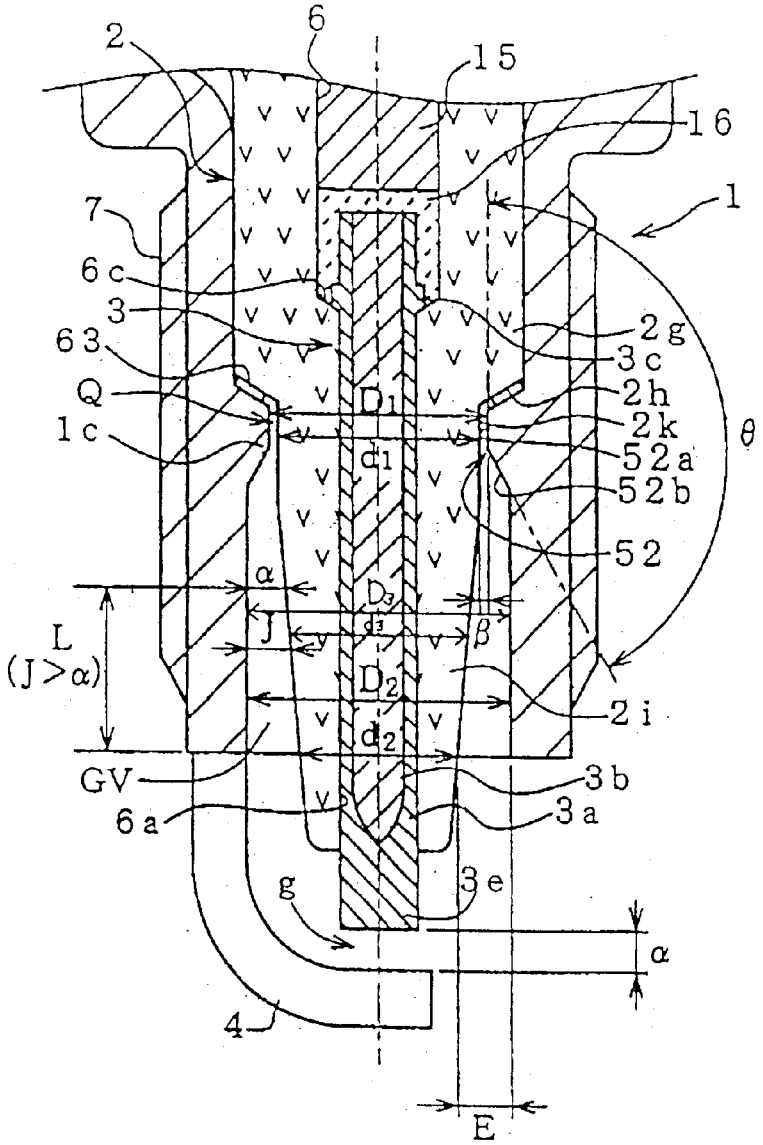
FIG. 2 is a longitudinal sectional view showing on an enlarged scale a principal portion of a front end section of the embodiment of FIG. 1.

FIG. 1 and FIG. 2 show a spark plug 100 as an embodiment of the present invention. FIG. 1 is a longitudinal sectional view of the embodiment as a whole, and FIG. 2 shows a front end-side principal portion thereof on an enlarged scale. The spark plug 100 is provided with a cylindrical main metal member 1, an insulator 2 fitted inside the main metal member so that a front end portion 2*i* of the insulator projects from the main metal member, a center electrode 3 provided inside the insulator 2 with a front end portion 3*e* projecting from the insulator, an earth electrode 4 arranged so that it is joined at one end thereof to the main metal member 1 by welding, etc., and bent sideways at the other end portion thereof and opposed at a side surface of the bent end portion to a front end portion of the center electrode 3, and other parts. As shown in FIG. 2, a spark discharge gap g of width α is formed between the earth electrode 4 and center electrode 3. The earth electrode 4 and a main body 3*a* of the center electrode 3 are formed of a Ni alloy. A core member 3*b* formed of Cu or a Cu alloy is buried in an inner portion of the main body 3*a* of the center electrode 3 for promoting heat radiation.

The main metal member 1, formed in a cylindrical shape out of a metal, such as low carbon steel and the like, constitutes a housing of the spark plug 100, and has a fixing screw (fitting thread) 7 used to fix the spark plug 100 to an engine block (not shown) and formed on an outer circumferential surface thereof. The reference numeral 1*e* denotes a tool locking portion with which a tool, such as a spanner or a wrench, etc. is engaged when the main metal member 1 is fixed to an outer surface of the insulator, and this tool locking portion has a hexagonal cross-sectional shape. The insulator 2 is an integrally formed alumina ceramic sintered body, and provided with a through hole 6 extending along an axis O thereof. A terminal metal member 13 is fixed in one end portion of the through hole, and the center electrode 3 similarly in the other end portion thereof. A resistance member 15 is provided in the portion of the interior of the through hole 6 which is between the terminal metal member 13 and center electrode 3. Both end portions of the resistance member 15 are electrically connected to the center electrode 3 and terminal metal member 13 respectively via conductive glass seal layers 16, 17. The resistance member 15 and conductive glass seal layers 16, 17 form a sintered conductive material. The resistance member 15 is formed of a resistance composition produced from a raw material of a mixed powder of a glass powder and a powder of a conductive material (and a powder of a ceramic material other than glass as needed).

A projection 2*e* extending in the circumferentially outward direction in the shape of, for example, a flange is provided on an axially intermediate portion of the insulator 2. In the insulator 2, the section extending in the axial direction O toward the front end portion 3*e* (i.e., a spark discharge gap g) of the center electrode 3 is called a front portion, and in the section on the rear side of the projection 2*e* a main portion 2*b* is formed to a diameter smaller than that of the projection 2*e*. On the front side of the projection 2*e*, a first shaft portion 2*g* the diameter of which is smaller than that of the projection, and a second shaft portion 2*i* the diameter of which is further smaller than that of the first shaft portion 2*g*, are formed in the mentioned order. The main portion 2*b* may be provided with a corrugation on a rear end section of the outer circumferential surface thereof.

A diameter of a cross section of the center electrode 3 is set smaller than that of a cross section of the resistance member 15. The through hole 6 of the insulator 2 has a first substantially cylindrical portion 6*a* through which the center electrode 3 is inserted, and a second substantially cylindrical portion 6*b* formed on the rear side (upper side in the drawings) of the first portion 6*a* to a diameter larger than that of the first portion. The terminal metal member 13 and resistance member 15 are housed in the second portion 6*b*, and the center electrode 3 is inserted through the interior of the first portion 6*a*. On a rear end portion of the center electrode 3, an electrode fixing projection 3*c* outwardly extending from an outer circumferential surface thereof is formed. The first portion 6*a* and second portion 6*b* of the through hole 6 are joined together in the first shaft portion 2*g* of FIG. 2. In a position in which the first and second portions 6*a*, 6*b* are joined together, a reception surface 6*c* for receiving the electrode fixing projection 3*c* is formed as a tapering surface or an arcuate surface.

The insulator 2 is inserted into the main metal member 1 from a rear opening thereof, and a portion at which the first shaft portion 2*g* and second shaft portion 2*i* are joined together is formed as a circumferentially extending stepped portion. This stepped portion serves as an insulator locking portion 2*h*, and is engaged with a circumferentially extending annular projection 1*c* as a metal member-side locking portion formed on an inner surface of the main metal member 1 via a ring-shaped plate packing 63, to thereby prevent the insulator from axially slipping out from the main metal member. Between an inner surface of a rear opening of the main metal member 1 and a corresponding portion of the outer surface of the insulator 2, a ring-shaped line packing 62 engaged with a rear circumferential edge of the flange-like projection 2*e* is provided. On the rear side of the packing 63, a ring-shaped line packing 60 is provided via a packed layer 61 of talc and the like. The insulator 2 is forced forward into the main metal member 1, and an opened edge of the main metal member 1 is then crimped inward toward the packing 60 to thereby form a crimped portion 1*d*, the main metal member 1 thus being fixed to the insulator 2.

As shown in FIG. 2, the portion of the insulator which is positioned forward of the insulator locking portion 2*h*, i.e., an outer circumferential surface (clearance-forming outer circumferential surface) 2*k* of the second shaft portion 2*i*, is opposed to an inner circumferential surface (clearance-forming inner circumferential surface) 52 of the projection 1*c* forming a metal member locking portion so as to form a predetermined clearance amount Q in the locking position. An amount β expressed by the equation:

$$\beta=(D1-d1)/2 \quad (1)$$

wherein d1 represents an outer diameter of the clearance-forming outer circumferential surface 2*k*; and D1 represents an inner diameter of the clearance-forming inner circumferential surface 52, of a clearance in the locking position, is set to not higher than 0.4 mm (preferably not lower than 0.05 mm).

When the amount β of a clearance in the above-mentioned locking position is set to not higher than 0.4 mm, entry of unburnt gas into the clearance Q can be reliably blocked. This is the case even in an environment of use in which contamination of the spark plug is liable to occur at, for example, the predelivery time. Therefore, contamination of the surface (clearance-forming outer circumferential surface 2*k*) of the insulator 2 in the clearance Q in the locking position can be prevented. As a result, the spark plug 100 can be miniaturized without impairing the fouling resistance thereof. For example, even when a nominal size of the fixing screw 7 formed on the outer circumferential surface of a front end portion of the main metal member 1 is reduced to not higher than M12, excellent fouling resistance can be maintained. Concretely, the fixing screw 7 can actually employ a value of M12 or M10, etc. (as used herein, the nominal size of the fixing screw means a value specified by ISO 2705 (M12) and ISO 2704 (M10), and naturally allows variation within the scope of dimensional tolerance of these standards). According to the present invention, the clearance Q in the locking position is set not higher than 0.4 mm which is lower than a corresponding level in a related art spark plug. Therefore, even when the size of the fixing screw 7 is reduced, the wall thickness of the portion of the insulator 2, which is in a position in which the insulator is engaged with the main metal member, does not have to be greatly reduced. Accordingly, the fouling resistance of the spark plug is improved due to the width-reduced clearance Q in the locking position, and the voltage resisting characteristics of the insulator 2 is maintained.

In this embodiment of the invention, the outer circumferential surface of the first shaft portion 2*g* is formed to a substantially cylindrical shape, while the outer circumferential surface, which constitutes the clearance-forming outer circumferential surface 2*k* of the base end section of the second shaft portion 2*i*, is formed to a cylindrical shape substantially coaxial with the clearance-forming inner circumferential surface 52, in such manner that the clearance Q in the locking position becomes substantially constant (and minimal) in the axial direction O. The outer circumferential surface of the portion of the insulator forward of the second shaft portion 2*i* is formed conically so that the diameter of this portion decreases gradually toward the front end thereof.

When the nominal size of the fixing screw 7 is reduced as mentioned above, it should be noted that the width J for a gas volume portion GV, i.e., a wide open clearance formed in front of the clearance Q or rather formed between a conical portion (second shaft portion 2*i*) of the insulator 2 and the metallic shell 1 have to be reduced. When the width J becomes excessively small and even if the interior of the clearance Q in the locking portion is clean, the conical second shaft portion 2*i* extending forward of the clearance Q becomes contaminated to render so-called lareral jumping sparks occuring in the gas volume portion GV between the the conical second shaft portion of the insulator and the metal member. In order to prevent the occurrence of such jumping sparks, it is effective to set a width E of a front end section of the gas volume portion expressed by the equation:

$$E=(D2-d2)/2 \quad (2)$$

wherein D2 represents an inner diameter of an opened portion of the front end surface of the main metal member 1; and d2 represents an outer diameter of the portion of the insulator 2 (second shaft portion 2*i*) which is in the position of the mentioned front end surface, in such manner that the width E satisfies the expression:

$$1.1\alpha<E \quad (3)$$

wherein α represents a width of the spark discharge gap g.

The electric field tends to concentrate in the section of the insulator 2 which is in the vicinity of the front end portion thereof close to the spark discharge gap g. Since an edge on which the electric field tends to concentrate is formed on the inner periphery of the end surface of the main metal member 1, the problem of lateral jumping sparks in the gas volume portion GV tends to occur easily in the position of the front end surface of the main metal member 1. However, when the width of the gas volume portion GV in this position, i.e., the width E of the front end surface of the main metal member 1 of the gas volume portion, is set larger than the width α of the spark discharge gap g, which is in a proper spark jumping position, the occurrence of the lateral jumping sparks can be effectively suppressed even when the surface of the insulator 2 (second shaft portion 2*i*) is contaminated. As used herein, the width E of the front end surface of the main metal member 1 of the gas volume portion is defined as the difference between the diameter of the main metal member 1 and that of the insulator 2 shown in equation (2). However, when slight decentering of parts occurs when combining, for example, the insulator 2 with the main metal member 1, it is expected that an actual distance between the inner circumferential surface of the main metal member 1 and the outer circumferential surface of the insulator 2 (second shaft portion 2*i*) decreases locally to give rise to the problem of lateral jumping sparks in the above mentioned position. Therefore, in order to eliminate such influence, the value of E is set to a slightly liberal level as shown in expression (3). However, when the dencentering, etc., of parts during the combining thereof can be reliably prevented, the value of E may be set to $\alpha<E$ without problem.

The lateral jumping sparks ascribed to contamination of the front end portion of the insulator 2 (second shaft portion 2*i*) do not always occur in the position of the end surface of the main metal member 1. Lateral jumping sparks may also occur in a position at a slightly rear portion of the main metal member when the width of the gas volume portion GV is at a certain level. In order to prevent the occurrence of such lateral jumping sparks, it is effective that the following expression:

$$\alpha<(D3-d3)/2 \quad (4)$$

wherein d3 represents a diameter of a contour of a cross section taken along an imaginary plane orthogonally crossing the axis O, of the portion of the insulator 2 forward of the insulator locking portion 2*h*; and D3 represents an inner diameter of the portion of the main metal member 1 which corresponds to this portion of the insulator, is satisfied at an arbitrary position in a section between the position of the front end surface of the main metal member 1 and a position higher than the same by at least 7 mm, i.e., it is effective that $\alpha<(D3-d3)/2$ is satisfied in a section L not less than 7 mm above the position of the front end surface of the main metal member 1.

When a width J ($\equiv(D3-d3)/2$) of the gas volume portion GV in a certain position in the axial direction O is larger than the width α of the spark discharge gap g, lateral jumping sparks tend not to occur at that position. On the other hand, the strength of the electric field, which influences the occurrence of lateral jumping sparks, on the surface of the insulator becomes high in a position in the vicinity of the front end portion close to the spark discharge gap g but decreases gradually toward a rear side in the axial direction O. However, according to the findings of the present inventors, an electric field strength distribution simulation based on a finite element method predicts that the electric field strength of the insulator surface becomes somewhat high in a section between the position of the front end surface of the main metal member and a position around 7 mm above the same position with respect to the axial direction. Thus, there was the expectation of the occurrence of lateral jumping sparks. In view of the above, when the width J of the gas volume portion is set in at least this section so that the width becomes larger than α of the spark discharge gap g which is a proper place for the electric discharge, the occurrence of lateral jumping sparks in a position on a rear side portion of the main metal member 1 may be effectively suppressed.

A contour of a cross section, which is taken along an imaginary plane including the axis O (which agrees in this embodiment with the axis of the main metal member 1 as well) of the insulator 2, of the clearance-forming inner circumferential surface 52 of the projection 1*c* constituting the metal member-side locking portion has a flat portion 52*a* opposed to the clearance-forming outer circumferential surface 2*k*, and an inclined portion 52*b* extending downward from the front end of the flat portion 52*a* toward the inner circumferential surface of the main metal member 1. An angle θ formed between the flat portion 52*a* and inclined portion 52*b* satisfies the expression:

$$140^\circ \leqq \theta \leqq 160^\circ \quad (5).$$

In a position in which the flat portion 52*a* and inclined portion 52*b* cross each other (meet), an edge portion is formed. When the angle θ formed between the portions 52*a*, 52*b* is set somewhat large as shown in the expression (5), the excessive concentration of electric field on the edge portion can be avoided, and the voltage resisting performance of the spark plug can be further improved. However, when θ is smaller than 140°, the voltage resisting performance improving effect is low. When θ exceeds 160°, the lower end section of the inclined portion 52*b* gradually extends over a long distance toward the lower part of the inner circumferential surface of the main metal member 1, and a region of a high electric field strength of the gas volume portion GV extends to the front end portion of a small wall thickness of the insulator 2 (second shaft portion 2*i*). Consequently, the voltage resisting performance of the spark plug becomes impaired in some cases. Moreover, a section in which the width J of the gas volume portion GV decreases becomes long, which works disadvantageously as to prevention of the occurrence of lateral jumping sparks in some cases. In this embodiment of the invention, the flat portion 52*a* forms a cylindrical surface concentric with the outer circumferential surface 2*k* of the base end section of the second shaft portion 2*i*, while the inclined portion 52*b* is formed to a conical shape.

Various modifications capable of being added to the spark plug 100 will now be described (the same reference numerals are assigned to parts shown in both FIG. 1 and FIG. 2, and detailed descriptions of such parts will be omitted). First, referring to FIG. 3, a mode is employed in which a front end body portion 2*s* is joined to a cylindrical base end portion 2*r* of the second shaft portion 2*i* via a diameter-reduced portion 2*j* so that a length of the section L, in which the width J of the gas volume portion GV becomes larger than the width α of the spark discharge gap g, can be set as large as possible. In this embodiment of the invention, the diameter-reduced portion 2*j* is formed so as to have a conical (tapering) surface. As such, an edge of an acute angle on which an electric field tends to concentrate is avoided.

Figure 3:
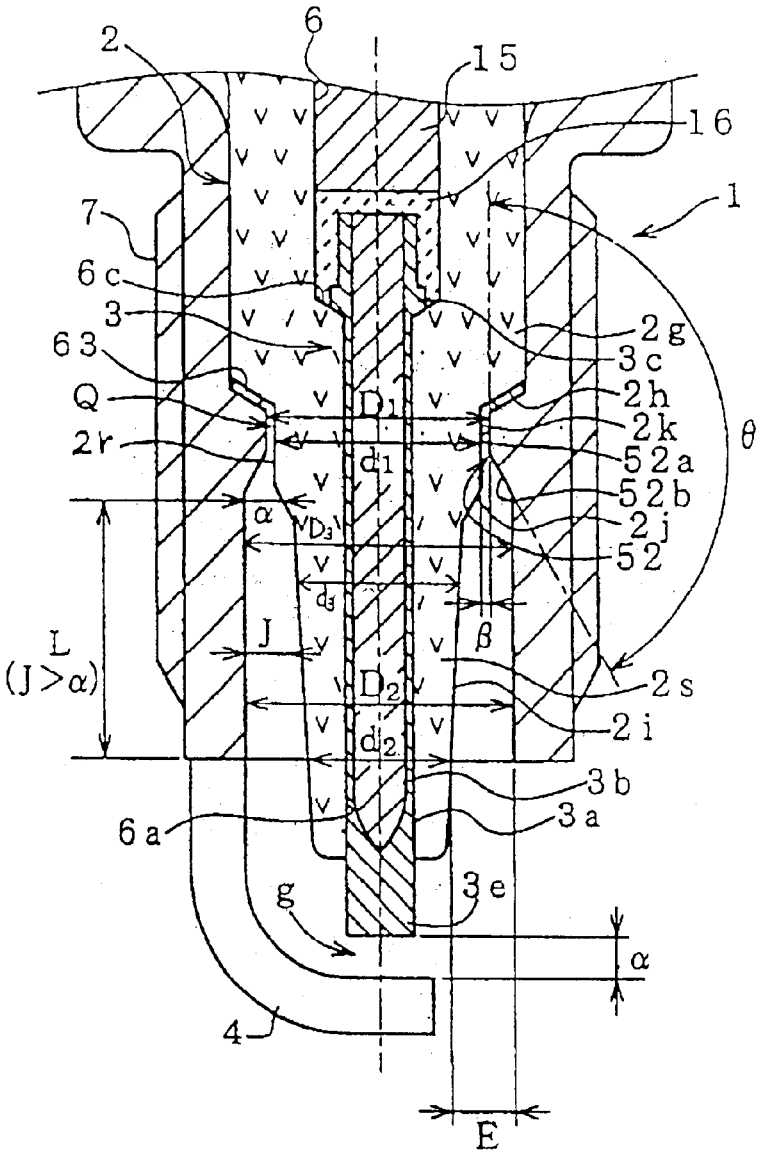
FIG. 3 is a longitudinal sectional view showing a principal portion of a first modified example of the spark plug of FIG. 1.
Figure 4:
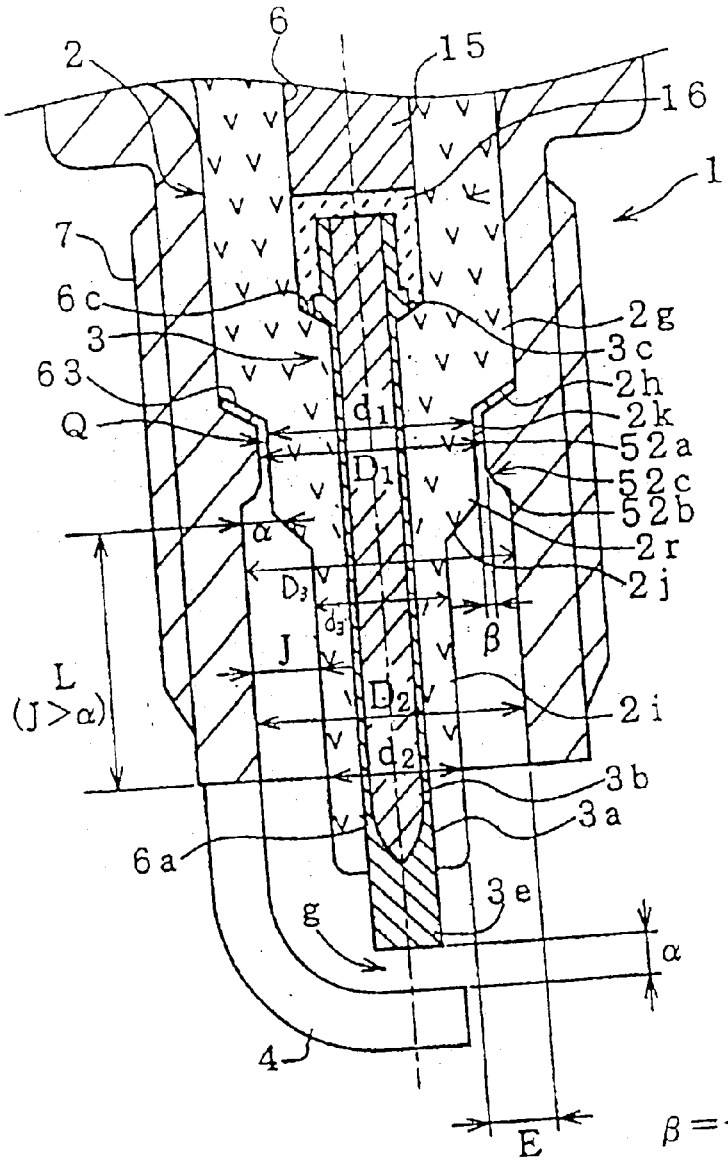
FIG. 4(*a*) is a longitudinal sectional view showing a principal portion of a second modified example of the spark plug of FIG. 1.
Figure 4:
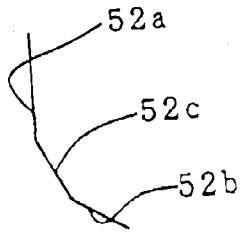
Figure 4:
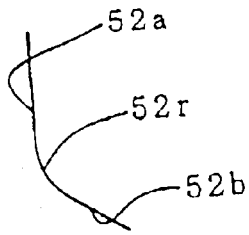

In the embodiment of FIG. 4(*a*), a contour of a cross section, which is taken along an imaginary plane including an axis O, of a clearance-forming inner circumferential surface 52 of a projection 1*c* forming a metal member-side locking portion also has a flat portion 52*a* opposed to a clearance-forming outer circumferential surface 2*k*, and an inclined portion 52*b* extending downward from a front end section of the flat portion 52*a* toward a lower portion of the inner circumferential surface of the main metal member 1. A chamfered portion 52*c* is formed at a position in which the flat portion 52*a* and inclined portion 52*b* cross each other (an enlarged view is shown in FIG. 4(*b*)). Owing to this structure, an electric field tends not to concentrate at the position in which the flat portion 52*a* and inclined portion 52*b* cross each other, and an effect identical with that obtained when a large angle θ is formed between the flat portion 52*a* and inclined portion 52*b* can be attained. The embodiment of FIG. 4(*a*) has a mode in which a second shaft portion 2*i* of the insulator 1 has a front end body portion 2*s* joined to a cylindrical base end portion 2*r* via a diameter-reduced portion 2*j* in the same manner as in the embodiment of FIG. 3. In the embodiment of FIG. 3, the outer circumferential surface of the front end body portion 2*s* is formed into a conical surface, while, in the embodiment of FIG. 4(*a*), the outer circumferential surface of the front end body portion 2*s* is formed into a cylindrical surface so that the width J of the gas volume portion GV is as large as possible up to a position on the rear side of the front end of the main metal member 1. As shown in FIG. 4(*c*), an arcuate portion 52*r* may be provided instead of the chamfered portion 52*c*.

A noble metal ignition portion of not larger than 1 mm in diameter containing Ir or Pt as a main component may be fixed to a front end surface of the center electrode 3. When the diameter of the front end portion of this electrode is reduced to not larger than 1 mm, an electric field can be concentrated on the front end portion, which is opposed to a spark discharge gap g, of the electrode, so that the necessary discharge voltage can be reduced, and thereby lateral jumping sparks in the gas volume GV are effectively suppressed. Since the front end portion of the electrode is equipped with the noble metal ignition portion, spark consumption is suppressed and the lifetime of the spark plug is prolonged. Due to reduction of the diameter of the fixing screw 7 on the main metal member 1, the discharge voltage decreases even when the wall thickness of the insulator 2 is somewhat reduced. This can provide the spark plug with more than enough voltage resisting capability in correspondence with the reduced discharge voltage. In view of the necessity of suppressing the progress of spark consumption in the noble metal ignition portion ascribed to excessive electric field concentration, the diameter of the noble metal ignition portion is preferably set to larger than 0.2 mm but not exceeding 1.0 mm.

In this embodiment of the invention, the noble ignition portion formed of an Ir alloy (alloy components are, for example, Rh, Pt or Ni, etc.) is fixed to the front end portion of the center electrode 3 by laser welding. An ignition portion formed of Pt or a Pt alloy (the alloy component is, for example, Ni, etc.) is fixed to an earth electrode 4 by resistance welding so as to be opposed to the ignition portion. The clearance between the ignition portion and the ignition portion opposed thereto is formed as the spark discharge gap g.

EXAMPLES

In order to illustrate the effect of the present invention, the following experiments were conducted.

Example 1

Spark plugs identical to that shown in FIG. 1 and FIG. 2, in which the nominal size of a fixing screw 7 was set to M12; a width cc of a spark discharge gap g was set to 1.1 mm; a ratio E/α of a width E of the front end surface of the main metal member of a gas volume portion to α was set to 1.4; a length of a section L in which J>α with respect to the width J of the gas volume portion was set to 7 mm; an angle θ formed between a flat portion 52*a* and an inclined portion 52*b* of a projection 1*c* was set to 150°; and a value β of a clearance in a locking position was set to various levels ranging from 0.1 to 0.6 mm, were prepared as test samples. In order to examine the pollution resistance of each spark plug, a predelivery endurance test was conducted under the following conditions. Namely, each of the spark plugs was fixed to a test automobile (displacement: 1500 cc, 4 serial cylinders) with a voltage application polarity of an earth electrode and a center electrode set to a positive polarity and a negative polarity, respectively. A traveling pattern (test room temperature: −10° C.) exemplified in JIS D1606 (1987) was determined as one cycle, and the traveling pattern was repeated until the insulating resistance of each of the spark plugs decreased to not higher than 10 MΩ. A judgement was made in accordance with the number of cycles. Not lower than 10 cycles was judged as "○", 8 to 9 cycles "Δ", and not higher than 6 cycles "×" ("○" and "Δ" are allowable, and "×" is not allowable). The results are shown in Table 1.

TABLE 1

| β(mm) | 0.1 | 0.2 | 0.4 | 0.6 |
|---|---|---|---|---|
| Judgement | ○ | ○ | ○ | X |

As shown above, when the clearance P in the locking position was set to not higher than 0.4 mm, the pollution resistance of the spark plugs is remarkably improved.

Example 2

Spark plugs identical to that shown in FIG. 1 and FIG. 2, in which the nominal size of a fixing screw 7 was set to M12; a width α of a spark discharge gap g was set to 1.1 mm; a ratio E/α of a width E of the front end surface of a gas volume portion to α was set to 1.4; an angle θ formed between a flat portion 52*a* and an inclined portion 52*b* of a projection 1*c* was set to 150°; an amount β of clearance in a locking position was set to 0.4 mm; and a length of a section L in which a width J of a gas volume portion becomes J>α was set to various levels of 5 to 8.3 mm, were prepared as test samples. In order to examine the low-temperature startability of each spark plug, tests were conducted under the following conditions. Namely, each of the spark plugs was fixed to a test automobile (displacement: 1500 cc, 4 serial cylinders) with a voltage application polarity of an earth electrode 4 and a center electrode 3 set to a positive polarity, and a negative polarity respectively. Tests in which a cycle of 30 seconds idling+30 minutes stopping were repeated to determine the number of cycles until a starting operation could not be carried out were conducted under two conditions including a room temperature of −30° C. and −10° C. In all cases, a judgement was made in accordance with the number of cycles. Not lower than 5 cycles was judged as "○" and not higher than 4 cycles as "×" ("○" is allowable, and "×" is not allowable). The results are shown in Table 2.

TABLE 2

| L(mm) | | 5 | 5.8 | 6.5 | 7 | 8.3 |
|---|---|---|---|---|---|---|
| Judgement | −30° C. | X | X | O | O | O |
| | −10° C. | O | O | O | O | O |

According to these results, no problems occurred in any test samples in the tests conducted at −10° C. In the tests conducted at −30° C., which was a lower temperature and constituted a severe condition, excellent results were obtained in test samples in which L was not smaller than 7 mm. It is considered that the reduced number of cycles allowing for a starting operation in test samples in which L was smaller than 7 mm resides in that lateral jumping sparks tend to occur due to progressive contamination of the insulator.

Example 3

Figure 5:
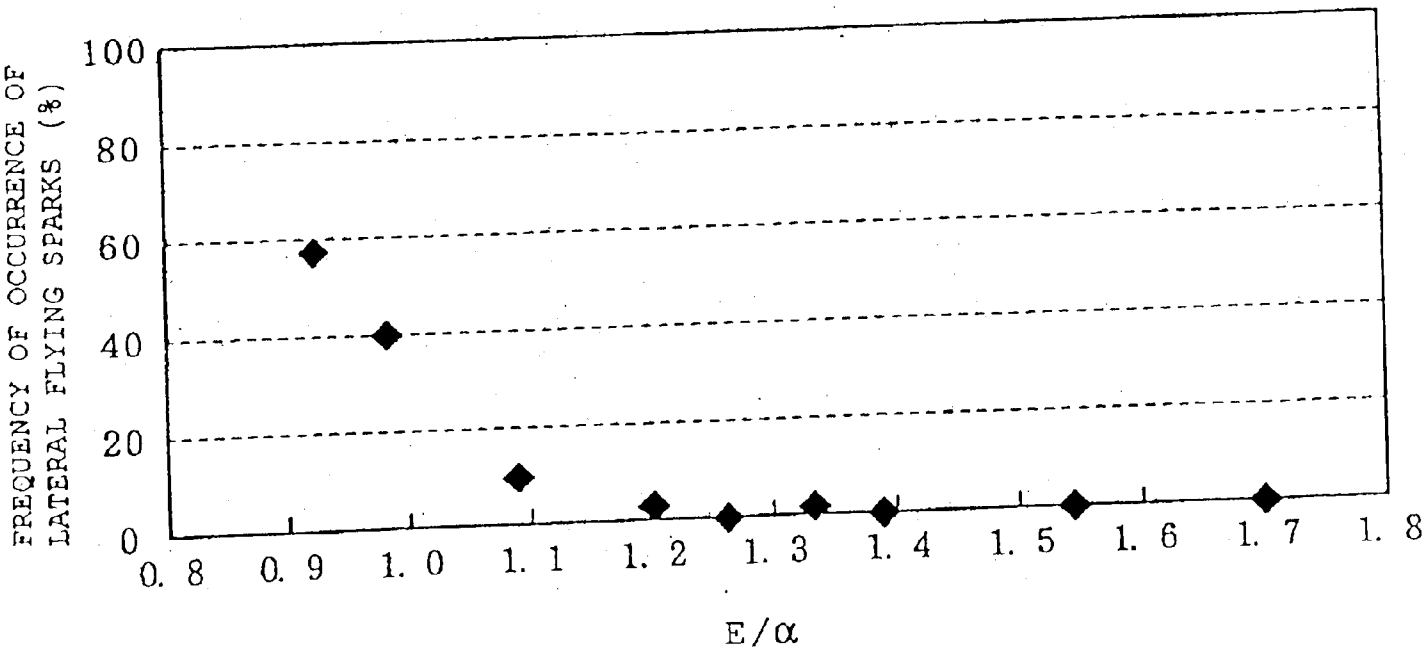
FIG. 5 is a graph showing the results of an experiment in Example 3.

Spark plugs identical to that shown in FIG. 1 and FIG. 2, in which the nominal size of a fixing screw 7 was set to M12; a width α of a spark discharge gap g was set to 1.1 mm; an angle θ formed between a flat portion 52*a* and an inclined portion 52*b* of a projection 1*c* was set to 150°; an amount β of clearance in a locking position was set to 0.4 mm; and a ratio E/α of a width E of the front end surface of a main metal member of a gas volume portion to α was set to various levels of from 0.9 to 1.7 by changing the angle of inclination of an outer circumferential surface of a second shaft portion 2*i*, were prepared as test samples. These spark plugs were subjected at their ignition portions to smoking in advance, and then set in a see-through chamber in which the air pressure was set to 0.4 MPa to generate electric discharge. The frequency of occurrence of lateral jumping sparks was determined by visually ascertaining the number of lateral jumping sparks generated onto a metal member during 1000 electric discharges. The results are shown in FIG. 5. It is understood from the drawing that, when E/α is set not lower than 1.1, the frequency of occurrence of lateral jumping sparks remarkably decreases.

Example 4

Spark plugs identical to that shown in FIG. 1 and FIG. 2, in which the nominal size of a fixing screw 7 was set to M12; a width α of a spark discharge gap g was set to 1.1 mm; a ratio E/α of a width E of the front end surface of a main metal member of a gas volume portion to α was set to 1.4; a length of a section L in which a width J of the gas volume portion becomes J>α was set to 7 mm; and an angle θ formed between a flat portion 52*a* and an inclined portion 52*b* was set to 135–170°, were prepared as test samples. Samples provided with a chamfered portion 52*c* (chamfering width of 0.5 mm) as shown in FIG. 4, instead of setting the angle θ to 120°, were also prepared.

The distribution of the electric field strength in the gas volume portion GV determined when the sizes and shape of these test samples were used as initial conditions. A simulated voltage of 10 kV was applied to a center electrode 3 using commercially available software and a finite element method, and the electric field strength in a position very close to a position in which the flat portion 52*a* and inclined portion 52*b* cross each other was read. The results are shown in Table 3.

TABLE 3

| θ | 135° | 140° | 150° | 160° | 170° | 120° (having a chamfered portion) |
|---|---|---|---|---|---|---|
| Electric field strength (kV/mm) | 32 | 25.9 | 24.8 | 23.3 | 21.4 | 21.3 |

Figure 6:
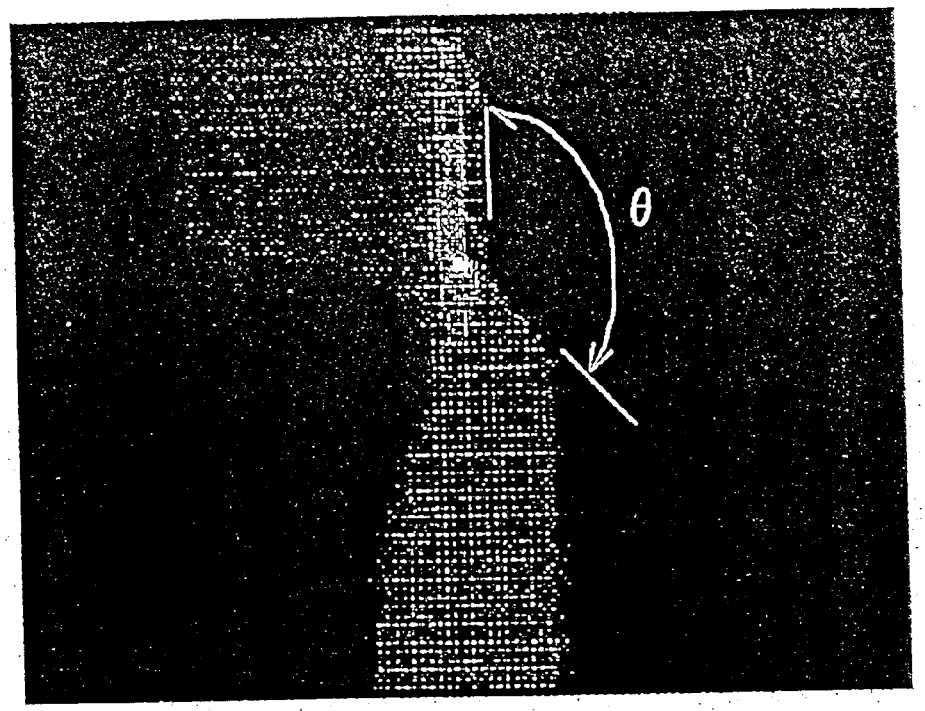
FIGS. 6(*a*) and 6(*b*) are drawings showing the results of the simulations of Example 4.
Figure 6:
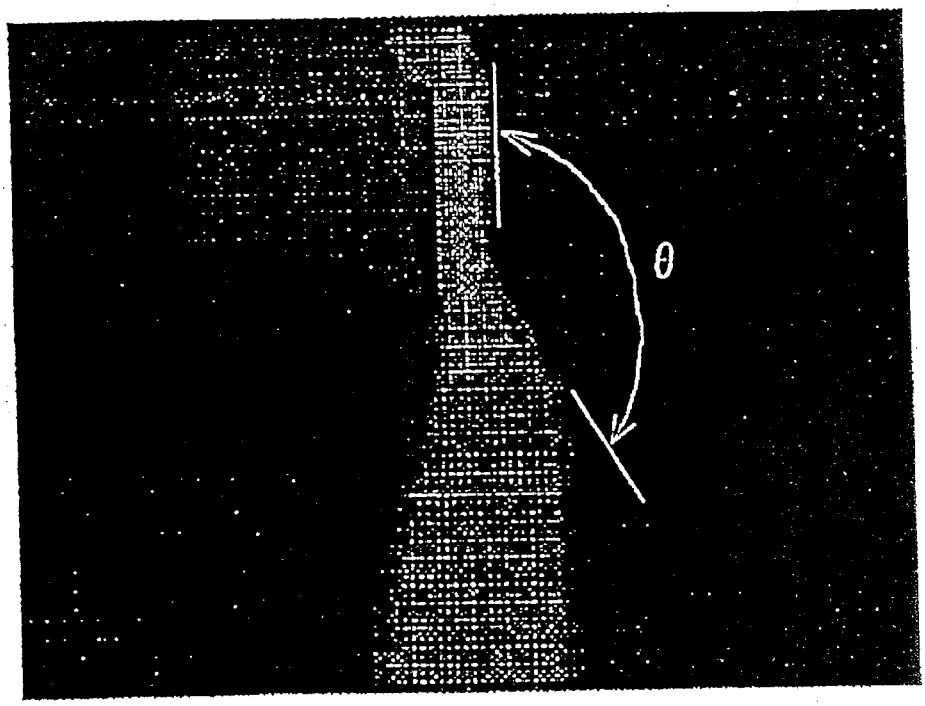

It is understood from this table that the electric field strength of the samples in which the angle θ was set to not smaller than 140°; or in which a chamfered portion was provided, decreased to a very low level. FIG. 6(*a*) and FIG. 6(*b*) show the results of simulations of spark plugs having θ=135° and θ=150°, respectively. Referring to these drawings, a brighter region shows a region of higher electric field strength. It is understood clearly from the drawings that an electric field concentrated portion of the former spark plug in which the angle θ is small appears noticeably in a position very close to the position in which the flat and inclined portions 52*a*, 52*b* cross each other, and that the degree of electric field concentration in the latter spark plug in which the angle θ is large is moderated.

The earth electrode was removed from each of these test samples, and the opened side of a main metal member of each of the resultant samples was immersed in a liquid insulating medium, such as a silicone oil. Thus, a space between the outer surface of the insulator and the inner surface of the main metal member was filled with the liquid insulating medium to insulate the two parts from one another. In this condition, a high AC voltage or a high pulse type voltage was applied from a high-voltage source between the main metal member and a center electrode 3, and a voltage waveform thereof was recorded by an oscilloscope. A voltage value recorded when piercing destruction occurred in the insulator was read as a through breakdown withstand voltage from the voltage waveform. Forty test samples under each test condition were tested, and an average value and a minimum value of the withstand voltages were determined. The results of the above tests are shown in Table 4.

TABLE 4

| θ | | 135° | 140° | 150° | 160° | 170° | 120° (having a chamfered portion) |
|---|---|---|---|---|---|---|---|
| Withstand voltage | Average | 36.1 | 38.1 | 39.8 | 39.2 | 38.4 | 40.1 |
| | MIN | 33 | 35 | 37 | 36 | 33 | 38 |

The above results show that both the average values and minimum values of withstand voltage of the test samples having an angle θ of 140° to 160° or a chamfered portion are high, and that such test samples have a stable voltage resisting performance. On the other hand, when the angle θ is lower than 140°, both an average value and a minimum value of the withstand voltage decrease, and the voltage resisting performance of the test samples relatively decreases. The results also show that, when the angle θ exceeds 160°, the minimum value of the withstand voltage decreases, though the average value thereof is comparatively good, and scatter of the voltage resisting performance of the test samples tends to easily occur.

It should further be apparent to those skilled in the art that various changes in form and detail of the invention as shown and described above may be made. It is intended that such changes be included within the spirit and scope of the claims appended hereto.

This application is based on Japanese Patent Application No. 2000-397381 filed Dec. 27, 2000, the disclosure which is incorporated herein by reference in its entirety.

What is claimed is:

1. A spark plug having a center electrode (3), an insulator (2) provided on the outer side of the center electrode (3), a cylindrical main metal member (1) provided on the outer side of the insulator (2), and an earth electrode (4) which is provided so that the earth electrode is combined at one end portion thereof with the main metal member (1) and opposed at the other end portion thereof to a free end of the center electrode (3), and which forms a spark discharge gap g having a width α between the earth electrode and center electrode (3), said spark plug having a front side at which the spark discharge gap g is positioned with respect to an axial direction O of the insulator (2) with the other side being a rear side, characterized in that:

the insulator (2), a diameter of a front end portion **(2*i*) of which is reduced by a circumferentially extending stepped portion thereof provided as an insulator-side locking portion (2*h*), is inserted into the main metal member (1) from a rear opening thereof, the insulator-side locking portion (2*h*) is engaged with a metal member-side locking portion (1*c*) projecting from an inner circumferential surface of the main metal member (1) with a clearance-forming outer circumferential surface (2*k*) of the portion (2*i*) positioned ahead of the locking portion (2*h*) of the insulator (2) opposed to a clearance-forming inner circumferential surface (52)** so as to form in a locking position a clearance of a predetermined amount therebetween, and an amount β of a clearance in a locking position is expressed by equation (1):

$$\beta=(D1-d1)/2 \quad (1)$$

wherein d1 represents an outer diameter of the clearance-forming outer circumferential surface **(2*k*); and D1 represents an inner diameter of the clearance-forming inner circumferential surface 52**, where β is not higher than 0.4 mm but not less than 0.05 mm.

2. The spark plug as claimed in claim 1, wherein a width E of the front end surface of the main metal member (1) of a gas volume portion is expressed by equation (2):

$$E=(D2-d2)/2 \quad (2)$$

wherein D2 represents an inner diameter of the front end opening of the main metal member (1); and d2 represents an outer diameter of the portion of the insulator (2) which corresponds to the front end surface of the main metal member (1), satisfies:

$$1.1\alpha<E \quad (3)$$

wherein a represents a width of the spark discharge gap g.

3. The spark plug as claimed in claim 1, wherein at least a 7 mm portion of the main metal member (1) above the front end surface thereof satisfies the expression:

$$\alpha<(D3-d3)/2 \quad (4)$$

wherein d3 represents a diameter of a contour of a cross section obtained by cutting the portion of the insulator (2) forward of the insulator locking portion **(2*h*) along an imaginary plane orthogonally crossing the axis O; and D3 represents an inner diameter of the portion of the main metal member (1)** at a corresponding axial position of said insulator portion.

4. The spark plug as claimed in claim 2, wherein at least a 7 mm portion of the main metal member (1) above the front end surface thereof satisfies the expression:

$$\alpha<(D3-d3)/2 \quad (5)$$

wherein d3 represents a diameter of a contour of a cross section obtained by cutting the portion of the insulator (2) forward of the insulator locking portion **(2*h*) along an imaginary plane orthogonally crossing the axis O; and D3 represents an inner diameter of the portion of the main metal member (1)** at a corresponding axial position of said insulator portion.

5. The spark plug as claimed in claim 1, wherein a contour of a cross section, which is obtained by cutting the main metal member (1) along an imaginary plane including the axis O, of the inner circumferential surface (52) of the metal member-side locking portion **(1*c*) has a flat portion (52*a*) opposed to the clearance-forming outer circumferential surface (2*k*), and an inclined portion (52*b*) extending downward from the flat portion (52*a*) toward the lower straight inner circumferential surface of the main metal member (1), wherein an angle θ formed by the flat portion (52*a*) and inclined portion (52*b*)** satisfies the expression:

$$140^\circ \leqq \theta \leqq 160^\circ \quad (5).$$

6. The spark plug as claimed in claim 2, wherein a contour of a cross section, which is obtained by cutting the main metal member (1) along an imaginary plane including the axis O, of the inner circumferential surface (52) of the metal member-side locking portion **(1*c*) has a flat portion (52*a*) opposed to the clearance-forming outer circumferential surface (2*k*), and an inclined portion (52*b*) extending downward from the flat portion (52*a*) toward the lower straight inner circumferential surface of the main metal member (1), wherein an angle θ formed by the flat portion (52*a*) and inclined portion (52*b*)** satisfies the expression:

$$140^\circ \leqq \theta \leqq 160 \quad (5).$$

7. The spark plug as claimed in claim 3, wherein a contour of a cross section, which is obtained by cutting the main metal member (1) along an imaginary plane including the axis O, of the inner circumferential surface (52) of the metal member-side locking portion **(1*c*) has a flat portion (52*a*) opposed to the clearance-forming outer circumferential surface (2*k*), and an inclined portion (52*b*) extending downward from the flat portion (52*a*) toward the lower straight inner circumferential surface of the main metal member (1), wherein an angle θ formed by the flat portion (52*a*) and inclined portion (52*b*)** satisfies the expression:

$$140^\circ \leqq \theta \leqq 160 \quad (5).$$

8. The spark plug as claimed in claim 1, wherein a contour of a cross section, which is obtained by cutting the main metal member (1) along an imaginary plane including the axis O, of the inner circumferential surface (52) of the metal member locking portion **(1*c*) has a flat portion (52*a*) opposed to the clearance-forming outer circumferential surface (2*k*), and an inclined portion (52*b*) extending downward from the flat portion (52*a*) toward the lower straight inner circumferential surface of the main metal member (1), wherein a chamfered portion (52***c*) or an arcuate portion (52*r*) is formed on a part at which the flat portion (52*a*) and inclined portion (52*b*) meet.

9. The spark plug as claimed in claim 1, comprising a noble metal ignition portion of not greater than 1 mm in diameter containing Ir or Pt as a main component thereof fixed to a front end surface of the center electrode (3).

10. The spark plug as claimed in claim 1, comprising a fixing screw portion (7) of a nominal size of not greater than M12 formed on a front end outer circumferential surface of the main metal member (1).

11. The spark plug as claimed in claim 1, wherein the amount β of the clearance is maintained over an axial distance of 0.5 mm to 2.5 mm.

12. The spark plug as claimed in claim 1, wherein the clearance-forming outer circumferential surface (2*k*) is parallel to the clearance-forming inner circumferential surface (52).

13. The spark plug as claimed in claim 1, wherein the clearance-forming outer and inner circumferential surfaces (2*k*), (52) maintain the amount β of the clearance over a distance of 0.5 mm to 2.5 mm in an axial direction of the spark plug.

14. The spark plug as claimed in claim 9, wherein the center electrode (3) has a noble tip welded thereto by laser.

* * * * *